United States Patent [19]

Goloff

[11] 3,981,640

[45] Sept. 21, 1976

[54] SLANT AXIS ROTARY MECHANISM

[75] Inventor: Alexander Goloff, East Peoria, Ill.

[73] Assignee: Caterpillar Tractor Co., Peoria, Ill.

[22] Filed: Sept. 8, 1975

[21] Appl. No.: 611,033

[52] U.S. Cl. ..... 418/51; 418/120; 418/121

[51] Int. Cl.[2] ..... F04C 27/00; F01C 19/10

[58] Field of Search ..... 418/49, 51, 52, 53, 418/68, 113, 119, 120, 121, 122, 123, 124, 142

[56] References Cited

UNITED STATES PATENTS

| | | | |
|---|---|---|---|
| 3,485,218 | 12/1969 | Clarke | 418/53 |
| 3,545,899 | 12/1970 | Clarke | 418/68 |
| 3,664,778 | 5/1972 | Nilsson | 418/121 X |
| 3,773,442 | 11/1973 | Mitchell et al. | 418/142 |
| 3,830,600 | 8/1974 | Shimoji et al. | 418/122 X |

OTHER PUBLICATIONS

A New Class of Rotary Piston Machine Suitable for Compressors, Pumps and Internal Combustion Engines, Clark et al., Proc. Instn. Mech. Eng., vol. 186, 6/72.

*Primary Examiner*—C. J. Husar
*Assistant Examiner*—Leonard Smith
*Attorney, Agent, or Firm*—Wegner, Stellman, McCord, Wiles & Wood

[57] ABSTRACT

An improved slant axis rotary mechanism including a housing defining an operating chamber, a shaft journalled in the housing having an angularly offset portion within the chamber and a rotor within the chamber and journalled on the angularly offset portion. The rotor has an annular flange provided with plural apices on each side thereof. Peripheral seals are carried about the periphery of the flange and sealingly engage the housing. At each apex there is a generally radially extending groove and an apex seal is loosely carried in each such groove and sealingly engages the housing. A bolt seal is carried at each apex on the periphery of the flange and sealingly engages the housing. Each bolt seal has a first pressure-responsive surface in fluid communication with the corresponding groove and a second pressure-responsive surface in fluid communication with the side of the flange opposite the corresponding apex. As a consequence, gas energization of the bolt seal will occur for all conditions of operation of the mechanism.

7 Claims, 3 Drawing Figures

SLANT AXIS ROTARY MECHANISM

BACKGROUND OF THE INVENTION

This invention relates to rotary mechanisms, and more particularly, to slant axis rotary mechanisms to be employed as engines, compressors, pumps, or the like.

In slant axis rotary mechanisms, peripheral seals engaging the outer spherical wall of the operating chamber seal well regardless of pressure differentials thereacross. The same is generally true of apex seals.

However, in the case of bolt seals, for certain stages in the cyclic operation of such mechanisms there is no ready path for fluid under pressure to be directed to the under side of the bolt seal to assist in biasing the same against the outer spherical wall. Consequently, the opportunity for the existence of an undesirable leakage path at each bolt seal at certain points in the operation of such mechanisms exists.

SUMMARY OF THE INVENTION

The principal object of the present invention is to provide a new and improved slant axis rotary mechanism. More specifically, it is an object of the invention to provide such a mechanism with improved means for energizing bolt seals thereof by gas during all stages of operating of such a mechanism regardless of pressure differentials.

The exemplary embodiment of the invention achieves the foregoing object in a slant axis rotary mechanism having a housing defining an operating chamber with a shaft journalled in the housing. The shaft has an angularly offset portion within the housing and a rotor is located within the chamber and journalled on the angularly offset portion. The rotor has an annular flange provided with plural apices on each side thereof and peripheral seals are carried about the periphery of the flange to sealingly engage the flange against the housing. At each apex there are located generally radially extending grooves for loosely receiving corresponding apex seals. Bolt seals are disposed at each apex on the periphery of the flange to sealingly engage the housing. Each such bolt seal has a first pressure-responsive surface in fluid communication with a corresponding groove and a second pressure-responsive surface in fluid communication with the side of the flange opposite the corresponding apex. For all points in a cycle of operation of such a mechanism, one or the other of the pressure-responsive surfaces will be subjected to substantial gas pressure to energize the bolt seal.

In a highly preferred embodiment, means are provided for preventing substantial fluid communication between the pressure-responsive surfaces to further minimize leakage.

Preferably, there is provided a stepped bore opening outwardly from the flange adjacent each apex. Each of such bores has a radially inner minor diameter portion and a radially outer major diameter portion and intersects the corresponding groove at adjacent apex. A stepped bolt seal is disposed in each of the bores. A fluid conduit establishes fluid communication with the minor diameter portion and the side of the flange opposite the corresponding apex.

Preferably, to prevent the previously mentioned leakage, the various grooves intersect only the major diameter portion of the associated bore.

Preferably, the two pressure-responsive surfaces are substantially equal in area to prevent over-energizing of the seal.

Other objects and advantages will become apparent from the following specification taken in connection with the accompanying drawings.

DESCRIPTION OF THE PREFERRED EMBODIMENT

Figure 1:
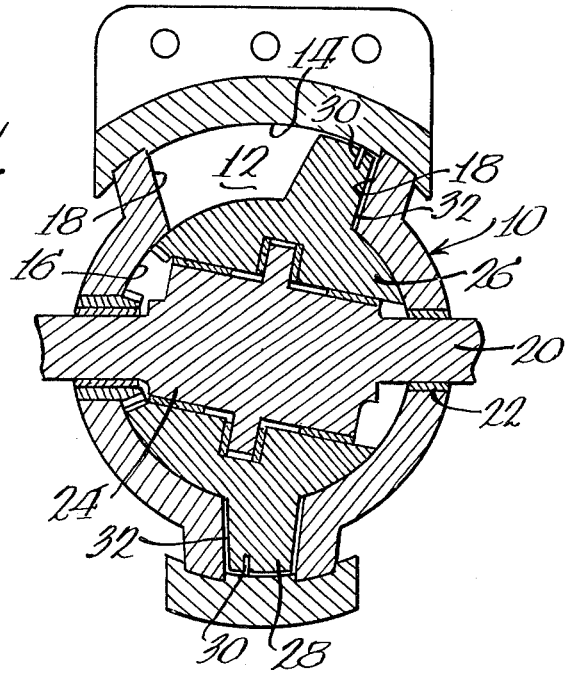
FIG. 1 is a sectional view of a slant axis rotary mechanism made according to the invention.

An exemplary embodiment of an improved slant axis rotary mechanism made according to the invention is seen in the drawings and, with reference specifically to FIG. 1, is in the form of a four-cycle engine. However, it is to be understood that the principles of the invention as hereinafter described are applicable to slant axis rotary mechanisms other than engines, such as pumps and compressors that have a number of cycles other than four.

The mechanism includes a housing, generally designated 10, defining an operating chamber 12 having an outer spherical wall 14, an inner spherical wall 16, and opposed, generally radially extending side walls 18 extending between the inner and outer spherical walls 14 and 16.

A shaft 20 is journalled in the housing 10 by means of suitable bearings 22 and includes an angularly offset portion 24 within the chamber 12. A rotor 26 is journalled on the angularly offset portion 24 and includes an annular flange 28.

Figure 2:
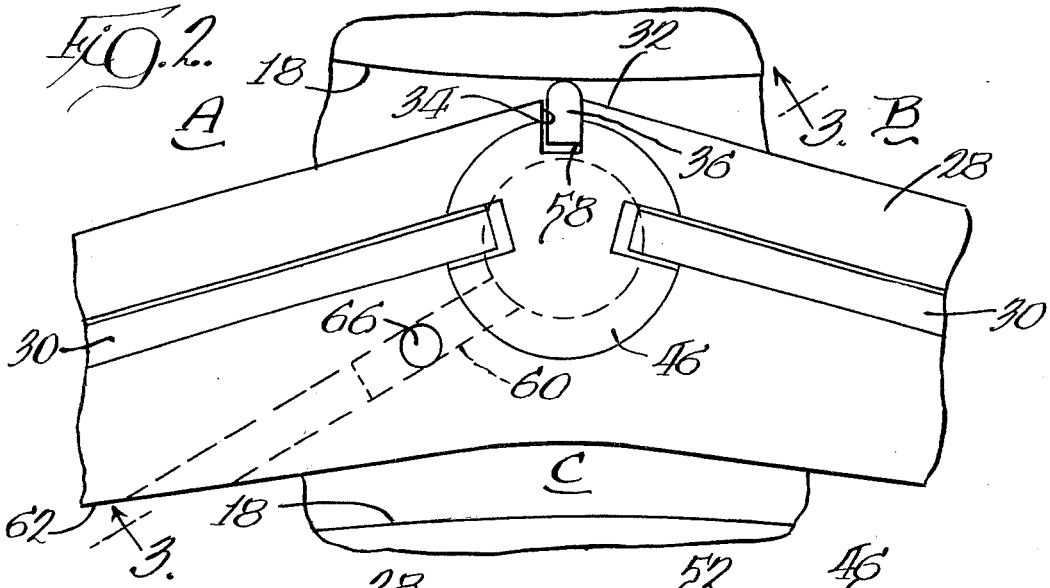
FIG. 2 is an enlarged, fragmentary view of a rotor apex and the seals carried by the rotor.

As best seen in FIG. 2, flange 28 on its periphery carries peripheral seals 30. The seals 30 are disposed in grooves, not numbered, but visible in FIG. 1, and sealingly engage the outer peripheral wall 14 of the mechanism. As is well known, the width of the seals 30 is less than the width of the grooves in which they are received so that the seals 30 may shift to one side or the other of the grooves in response to the pressure differentials with the high pressure side of the seal 30 being slightly spaced from the corresponding side of the grooves to permit the gas under pressure to enter the grooves to move under the seal 30 and bias the same into good sealing engagement with the outer spherical wall 14.

The sides of the flange 28 are provided with plural apices 32 on each side thereof. At each apex 32, a generally radially extending groove 34 is provided and an apex seal 36 is disposed therein. Each groove 34 is somewhat wider than the corresponding apex seal 36, as illustrated in FIG. 2, so that the seal may shift from side to side in the groove in response to pressure differentials existing thereacross. Again, the high pressure side of the apex seal 36 will be spaced slightly from the groove wall to allow gas under pressure to enter the groove and act against the underside of the apex seal 36 and bias the same into good sealing engagement with the corresponding one of the side walls 18.

Normally, in the case of both the peripheral seals 30 and the apex seals 36, an undulating spring or the like will be disposed within the groove to assist in biasing the associated seal out of the groove and into sealing engagement with the corresponding housing wall.

Figure 3:
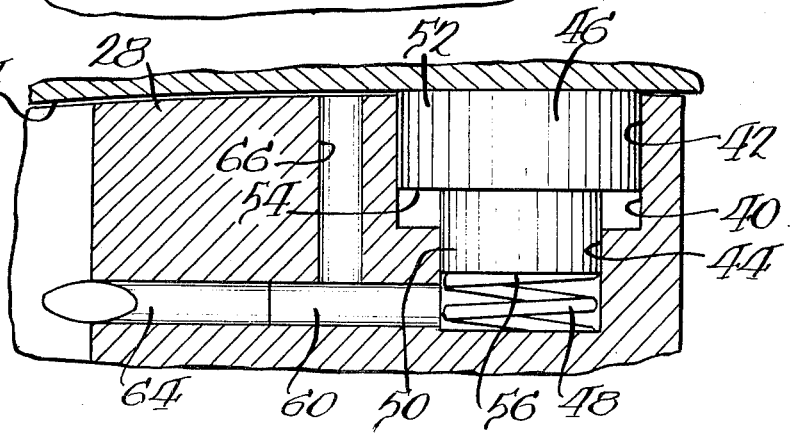
FIG. 3 is a sectional view taken along the line 3—3 of FIG. 2.

With reference to FIGS. 2 and 3, at each apex there is disposed an outwardly opening stepped bore 40. The radially outward portion of the bore 40 is designated 42 and is a major diameter portion of the bore 40. Conversely, the radially inner portion of the bore is designated 44 and is a minor diameter portion.

Within each bore 40 is a bolt seal 46 which sealingly engages the outer spherical wall 14. To assist in biasing the bolt 46 appropriately, a spring 48 may be disposed within the bore 40 to bear against the underside of the bolt 46.

The bolt 46 has a reduced diameter portion 50 which is slidably received in the minor diameter portion 44 of the bore 40. The bore 46 also includes an enlarged diameter portion 52 which is slidably received within the major diameter portion 42 of the bore 40.

As a consequence, the bolt 46 may be characterized as being stepped, and has a radial ledge 54 disposed within the major diameter portion 42 of the bore 40 and which serves as a first pressure-responsive surface.

The radially inner end of the bolt 46, numbered 56, is within minor diameter portion 44 of the bore 40 and acts as a second pressure-responsive surface.

As can be seen in FIG. 2, one side of the bolt 46 is slotted at 58 to receive an end of the apex seal 36. It is to be observed that the slot 58 and the groove 34 in the rotor do not extend inwardly of the apex 32 sufficiently to intersect the minor diameter portion 44 of the bore 40, but rather, only the major diameter portion 42 thereof.

A bore 60 from a side 62 of the rotor flange 28 extends into the minor diameter portion 44 of the bore 40 and is plugged by a plug 64 at its point of emergence in the side 62. A bore 66 opening on the periphery of the flange 28 intersects the bore 60. The point of emergence of the bore 66 is to one side of the associated apex seal 36 and on the side of the peripheral seals 30 opposite from the apex seal 36, as illustrated in FIG. 2.

Operation is as follows. With reference to FIG. 2, an area to the left of the apex seal 36 is designated A, while a similar area to the right of the apex seal 36 is designated B. A third area, on the opposite side of the flange 28, is designated C. Those skilled in the art will recognize that at all times during operation of the slant axis rotary mechanism, the areas A, B and C will be closed except when communicating with an intake or exhaust port. Since the areas are closed, pressure differentials will exist between the areas A, B and C. When gas in the area A is at a higher pressure than gas in the area B, the apex seal 36 will assume a position within the groove 34 corresponding to that illustrated in FIG. 2. Consequently, gas will be able to enter the groove 34 and apply pressure to the under side of the apex seal 36 to ensure sealing engagement. At the same time, because the groove 34 intersects the major diameter portion 42 of the bore 40, gas under pressure will be applied to the first pressure-responsive surface 54 to urge the bolt seal 46 into good sealing engagement with the wall 14.

If the pressure in the area B is higher than the pressure in the area A, the apex seal 36 will be moved to the left of the position shown in FIG. 2, whereupon gas from the area B will enter the groove 34 to exert pressure on the under side of the seal 36 to again achieve good sealing. At the same time, gas from the area B will pass through the groove 34 to be directed into the major diameter portion 42 of the bore 40 and exert such pressure against the first-pressure responsive surface 54 of the bolt 46 to again achieve good sealing engagement.

When there is no substantial pressure differential between the areas A and B, and pressure in the area C is greater than the pressure in either areas A or B, gas will pass through the conduit 66 to the conduit 60 to bear against the second pressure-responsive surface 56 to exert the requisite gas energization of the bolt 46. Thus, for the three extreme situations just described, and for all situations intermediate, the proper gas energization of the bolt seal 46 is obtained.

It should be noted that in order to eliminate the possibility of over-energization of the bolt 46, it is preferable that the area of the first pressure-responsive surface 54 be approximately equal to that of the second pressure-responsive surface 56.

It will also be recognized that the use of a stepped bore 40 precludes fluid communication between the two pressure-responsive surfaces thereby eliminating the possibility of establishing a leakage flow path from one side of the rotor flange to the other.

What is claimed is:

1. In a slant axis rotary mechanism, the combination comprising a. a housing defining an operating chamber, b. a shaft journalled in said housing having an angularly offset portion within said chamber, c. a rotor within said chamber and journalled on said angularly offset portion, said rotor having an annular flange provided with plural apices on each side thereof, d. peripheral seal means about the periphery of said flange sealingly engaging said housing, e. a generally radially extending groove at each apex, f. an apex seal loosely carried in each groove and sealingly engaging said housing, and g. a bolt seal at each apex on the periphery of said flange and sealingly engaging said housing, each said bolt seal having a first pressure-responsive surface in fluid communication with the corresponding groove and a second pressure-responsive surface in fluid communication with the side of the flange opposite the corresponding apex.

2. The slant axis rotary mechanism of claim 1 further including means for preventing substantial fluid communication between said surfaces.

3. In a slant axis rotary mechanism, the combination comprising a. a housing defining an operating chamber, b. a shaft journalled in said housing having an angularly offset portion within said chamber, c. a rotor within said chamber and journalled on said angularly offset portion, said rotor having an annular flange provided with plural apices on each side thereof, d. peripheral seal means about the periphery of said flange sealingly engaging said housing, e. a generally radially extending groove at each apex, f. an apex seal loosely carried in each groove and sealingly engaging said housing, g. a stepped bore opening outwardly from the flange adjacent each apex, each having a radially inner minor diameter portion and a radially outer major diameter portion, each said bore intersecting the corresponding groove at the adjacent apex, h. a stepped bolt seal received in each of said bores and sealingly engaging said housing, and i. means establishing fluid communication between each said minor diameter portion and a point on said flange opposite the corresponding apex, said point further being on the side of the peripheral sealing means opposite from the corresponding apex seal.

4. The slant axis rotary mechanism of claim 3 wherein said grooves intersect only the major diameter portions of the associated bore.

5. The slant axis rotary mechanism of claim 3 wherein the portion of each bolt seal received in the minor diameter portion has a cross-sectional area equal to approximately half of the cross-sectional area of the bolt seal portion received in said major diameter portion.

6. The slant axis rotary mechanism of claim 3 wherein said points are on the periphery of said flange.

7. The slant axis rotary mechanism of claim 6 wherein said points are each to one side of the corresponding apex.

* * * * *